US009759103B2

(12) United States Patent
Armenio et al.

(10) Patent No.: US 9,759,103 B2
(45) Date of Patent: Sep. 12, 2017

(54) LUBRICANT VANE PUMP

(71) Applicant: PIERBURG PUMP TECHNOLOGY GMBH, Neuss (DE)

(72) Inventors: Giacomo Armenio, Leghorn (IT); Nicola Novi, Turin (IT); Massimiliano Lazzerini, San Pietro in Palazzi (IT)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 237 days.

(21) Appl. No.: 14/777,518

(22) PCT Filed: Mar. 18, 2013

(86) PCT No.: PCT/EP2013/055527
§ 371 (c)(1),
(2) Date: Sep. 16, 2015

(87) PCT Pub. No.: WO2014/146675
PCT Pub. Date: Sep. 25, 2014

(65) Prior Publication Data

US 2016/0047280 A1 Feb. 18, 2016

(51) Int. Cl.
*F01M 1/02* (2006.01)
*F04C 2/344* (2006.01)
(Continued)

(52) U.S. Cl.
CPC ..... *F01M 1/02* (2013.01); *F04C 2/3442* (2013.01); *F04C 2/3448* (2013.01);
(Continued)

(58) Field of Classification Search
CPC F01M 1/02; F01M 2001/0238; F04C 2/3442; F04C 2/3448; F04C 13/001;
(Continued)

(56) References Cited

U.S. PATENT DOCUMENTS 4,272,227 A * 6/1981 Woodruff ..... F04C 14/14 417/440
2003/0059312 A1* 3/2003 Konishi ..... F01C 21/0863 417/213

(Continued)

FOREIGN PATENT DOCUMENTS

CN 101010513 A 8/2007
CN 101892981 A 11/2010

(Continued)

*Primary Examiner* — Michael Riegelman
(74) *Attorney, Agent, or Firm* — Norman B. Thot

(57) ABSTRACT

A lubricant vane pump for providing a pressurized lubricant for an internal combustion engine includes a pump housing, a pump chamber, a shiftable control ring comprising a pressure-relief-valve, a pump rotor, a pretensioning element which pushes the control ring into a high pumping volume position, a control chamber, and a pump outlet cavity fluidically connected to the control chamber. The pump chamber comprises pump compartments which rotate from a charge to discharge zone. The control ring envelops the pump chamber. The pump rotor comprises radially slidable vanes which rotate in the control ring to provide the pump chamber with the pump compartments. A high lubricant pressure in the control chamber moves the control ring into a low pumping volume direction against the pretensioning element. The pressure-relief-valve of the control ring connects or disconnects the control chamber with one of the pump compartments between the charge zone and the discharge zone.

9 Claims, 3 Drawing Sheets

(51) Int. Cl.

| | |
|---|---|
| ***F04C 14/10*** | (2006.01) |
| ***F04C 14/22*** | (2006.01) |
| ***F04C 13/00*** | (2006.01) |
| ***F04C 14/24*** | (2006.01) |
| ***F04C 15/00*** | (2006.01) |
| ***F04C 15/06*** | (2006.01) |

(52) U.S. Cl.
CPC ..... *F04C 13/001* (2013.01); *F04C 14/10* (2013.01); *F04C 14/22* (2013.01); *F04C 14/24* (2013.01); *F04C 15/008* (2013.01); *F04C 15/06* (2013.01); *F01M 2001/0238* (2013.01); *F04C 2210/206* (2013.01)

(58) Field of Classification Search
CPC ..... F04C 14/10; F04C 14/22; F04C 14/24; F04C 15/008; F04C 15/06; F04C 2210/206
See application file for complete search history.

(56) References Cited

U.S. PATENT DOCUMENTS

2006/0104823 A1* 5/2006 Hunter ..... F01M 1/16 417/44.2
2008/0038117 A1* 2/2008 Armenio ..... F04C 2/3442 417/26
2008/0069704 A1* 3/2008 Armenio ..... F04C 14/223 417/310
2008/0118372 A1* 5/2008 Hoshina ..... F04C 2/3442 417/220
2008/0247894 A1* 10/2008 Lutoslawski ..... F04C 2/3442 418/27
2009/0047147 A1* 2/2009 Yamamuro ..... F04C 14/223 417/310
2009/0081052 A1* 3/2009 Soeda ..... F04C 2/3442 417/213
2009/0196780 A1* 8/2009 Shulver ..... F04C 2/3442 418/27
2009/0202375 A1* 8/2009 Shulver ..... F01M 1/16 418/26
2010/0028171 A1* 2/2010 Shulver ..... F01M 1/16 417/307
2010/0080724 A1 4/2010 Jannausch et al.
2010/0086424 A1* 4/2010 Krug ..... F04C 2/3442 418/30
2010/0135835 A1* 6/2010 Armenio ..... F04C 14/223 418/27
2010/0221126 A1* 9/2010 Tanasuca ..... F01M 1/02 417/218
2013/0039790 A1* 2/2013 Cuneo ..... F04C 2/3442 418/17
2013/0071275 A1* 3/2013 Gasperini ..... F04C 2/3441 418/26
2013/0136641 A1* 5/2013 Novi ..... F01M 1/02 418/26
2013/0195705 A1* 8/2013 Williamson ..... F01C 20/18 418/24
2013/0263815 A1* 10/2013 Cuneo ..... F04C 2/3442 123/196 R
2013/0309113 A1* 11/2013 Rago ..... F04C 2/04 418/5
2014/0030120 A1* 1/2014 Cuneo ..... F04C 2/3442 417/364
2014/0199197 A1* 7/2014 Bowing ..... F04C 2/344 418/27
2015/0377234 A1* 12/2015 Miyajima ..... F01M 1/02 417/297
2016/0003243 A1* 1/2016 Celata ..... F04C 14/223 418/23
2016/0047280 A1* 2/2016 Armenio ..... F04C 2/3442 184/31
2016/0115832 A1* 4/2016 Celata ..... F04C 2/3442 417/364
2016/0138592 A1* 5/2016 Moriglia ..... F04C 2/3442 418/16
2016/0186623 A1* 6/2016 Valkenberg ..... F04C 2/344 418/26
2016/0290335 A1* 10/2016 Cuneo ..... F04C 2/3442

FOREIGN PATENT DOCUMENTS

CN 102906426 A 1/2013
EP 1 790 855 A2 5/2007
WO WO 2008/030491 A2 3/2008
WO WO 2012/113437 A1 8/2012

* cited by examiner

LUBRICANT VANE PUMP

CROSS REFERENCE TO PRIOR APPLICATIONS

This application is a U.S. National Phase application under 35 U.S.C. §371 of International Application No. PCT/EP2013/055527, filed on Mar. 18, 2013. The International Application was published in English on Sep. 25, 2014 as WO 2014/146675 A1 under PCT Article 21(2).

FIELD

The present invention relates to a mechanical variable lubricant vane pump for providing a pressurized lubricant for an internal combustion engine.

BACKGROUND

A mechanical lubricant vane pump is generally a volumetric pump which is driven by the engine. The lubricant vane pump is provided with a pump rotor body holding radially slidable vanes rotating inside a shiftable control ring. The slidable vanes, the rotor body, and the control ring wall define a plurality of rotating pump compartments which rotate in a pump chamber. The pump chamber is separated into a charge zone with an inlet opening, a discharge zone with an outlet opening, and an intermediate zone between the charge zone and the discharge zone. The intermediate zone is, seen in a rotating direction, arranged between the charge zone and the discharge zone. The pump compartments rotate from the charge zone, through the intermediate zone, to the discharge zone inside the control ring. The pump comprises a pretensioning element which pushes the control ring to a high pumping volume direction.

The control chamber acts against the pretensioning element when the pressure in the control chamber rises so that, if the rotational speed increases, the control ring is pushed into a low pumping volume direction to keep the outlet pressure constant; if the rotational speed decreases, the control ring is pushed into a high pumping volume direction, so that the lubricant is still pressurized with a more or less constant outlet pressure level more or less independent of the rotational speed of the pump rotor or of the engine.

The lubricant pumped by the lubricant vane pump is incompressible oil with an unavoidable fraction of compressible air. When the rotating pump compartments arrive at the discharge zone, the pressurized lubricant of the pump outlet cavity can flow backwards into the pump cavity so that oscillations of the lubricant volume can occur until the pressure outside and inside this pump compartment is equalized. The lubricant oscillation can lead to high pressure peaks and to hydraulic noise which causes acoustic noise, increased wear, and micro-vibrations of the lubricant vane pump.

Prior art pumps reduce the hydraulic noise of the lubricant vane pumps by pre-compressing the lubricant-air-mixture in the pump compartment passing an intermediate zone between the charge zone and the discharge zone before the pump compartment is connected to the discharge zone. This measure, however, reduces the efficiency of the lubricant vane pump.

SUMMARY

An aspect of the present invention is to provide an efficient lubricant vane pump with reduced hydraulic noise.

In an embodiment, the present invention provides a lubricant vane pump for providing a pressurized lubricant for an internal combustion engine which includes a pump housing, a pump chamber arranged in the pump housing, a shiftable control ring comprising a pressure-relief-valve arranged in the pump housing, a pump rotor arranged in the pump housing, a pretensioning element configured to push the shiftable control ring into a high pumping volume position, a control chamber, and a pump outlet cavity which is fluidically connected to the control chamber. The pump chamber comprises a plurality of pump compartments configured to rotate from a charge zone to a discharge zone. The shiftable control ring is configured to envelop the pump chamber. The pump rotor comprises radially slidable vanes which are configured to rotate in the shiftable control ring so as to provide the pump chamber with the plurality of rotating pump compartments. A high lubricant pressure in the control chamber moves the shiftable control ring into a low pumping volume direction against the pretensioning element. The pressure-relief-valve of the shiftable control ring is configured to connect or disconnect the control chamber with one of the plurality of pump compartments between the charge zone and the discharge zone under a defined connection condition.

BRIEF DESCRIPTION OF THE DRAWINGS

The present invention is described in greater detail below on the basis of embodiments and of the drawings in which.

DETAILED DESCRIPTION

Figure 1:
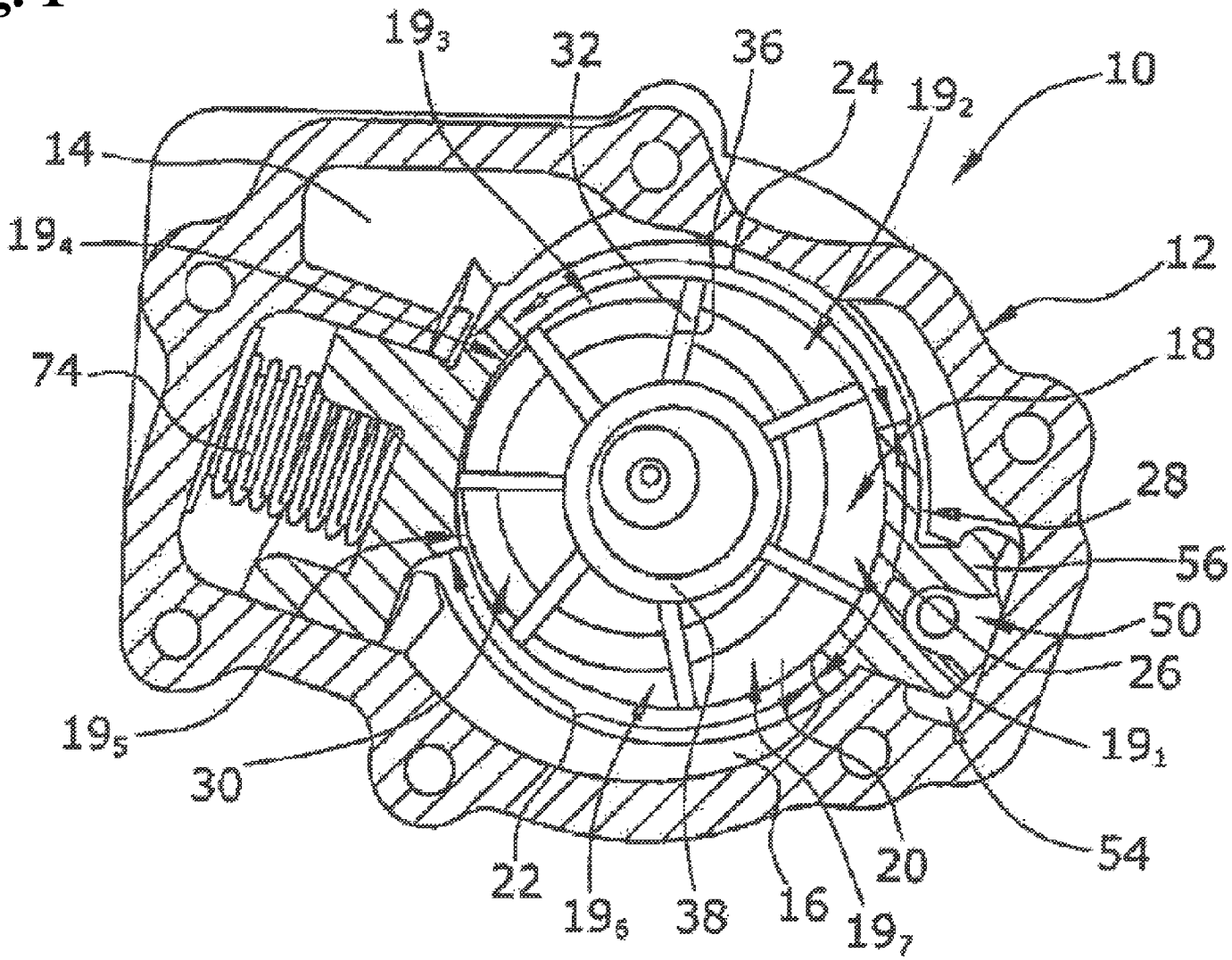
FIG. 1 shows a transversal cross section of an embodiment of a lubricant vane pump 10 in maximal eccentric position.

The lubricant vane pump for providing a pressurized lubricant for an internal combustion engine comprises a pump housing with a pump rotor. The pump rotor is provided with numerous radially slidable vanes which rotate in a shiftable control ring. The vanes can, for example, be arranged not exactly radially, but stabbing, so that they are more or less inclined with respect to a radial plane. The control ring is provided so as to be shiftable. The term "shiftable" here is not restricted to a linear movement of the control ring.

The pump rotor is provided with numerous radially slidable vanes which rotate in a shiftable control ring enveloping a pump chamber, wherein numerous rotating pump compartments rotate from a charge zone to a discharge zone. A pretensioning element pushes the control ring to a high pumping position. A pressure control chamber pushes the control ring to a low pumping volume direction against the force of the flexible pretensioning element and dependent on the liquid pressure in the control chamber.

The lubricant leaving the pump compartment in the discharge zone flows directly into the pump outlet cavity which is directly connected to the control chamber. The direct fluidic connection between the control chamber and the pump outlet cavity can be realized by a conduit which causes no relevant pressure drop even at high lubricant flow rates through the conduit.

The control ring is shiftable between a high pumping volume position and a low pumping volume position. The pumping performance and the delivery pressure of the vane pump can be adapted to the lubricant pressure demand. By changing the compartment displacement, the pumping volume of the vane pump can be varied by radially shifting the control ring so that the pump compartment displacement per rotation is changed.

The control ring is provided with a pressure-relief-valve integrated into the control ring and selectively connecting or disconnecting the control chamber with a pump compartment between the charge zone and the discharge zone under defined connection conditions. The pressure-relief-valve avoids effectively high local differential pressure peaks in the outlet cavity and in the discharge zone in general. The pressure-relief-valve provides a pressure equalization between the pump outlet cavity and the pump compartment in the intermediate zone even before the rotating pump compartment arrives at the discharge zone.

When the rotating pump compartment arrives at the discharge zone, the pressure differences are reduced so that the pressure peaks, the technical noise, and the wear are also accordingly reduced.

The pressure-relief-valve can be provided as a pressure-controlled-valve or as a position-controlled-valve. A position-controlled-valve is closed only when the control ring is in an extreme position.

In an embodiment of the present invention, the pressure relief valve can, for example, be provided as a pressure-controlled-valve. This pressure-controlled-valve is activated when a defined over-pressure is present in the pump outlet cavity with respect to the pump compartment in the discharge zone.

In an embodiment of the present invention, the pressure-relief-valve can, for example, be a one-way-valve which opens when a defined over-pressure in the control chamber with respect to the corresponding pump compartment is exceeded.

In an embodiment of the present invention, the pressure-relief-valve can, for example, be provided with a valve inlet opening, whereby the valve inlet opening is covered by a control chamber wall portion when the control ring is in the extreme high pumping volume position. This means that the lubricant vane pump includes a position-controlled-valve. This valve is purely dependent on and is controlled by the position of the control ring. If the maximum pumping capacity is required, the pressure-relief-valve is closed so that the pump performance is not reduced.

In an embodiment of the present invention, the pressure-relief-valve can, for example, be provided as a mechanical-check-valve. This mechanical check-valve provides a simple and reliable form of the pressure-controlled-valve. In contrast to an electrically activated valve, this type of valve is simply controlled by a pressure difference.

In an embodiment of the present invention, the pressure-relief-valve can, for example, be arranged in a section of the control ring in an intermediate zone between the charge zone and the discharge zone. The pressure-relief-valve, which can be realized as a radial groove conduit or bore in the control ring, allows a calibrated leakage so that high differential pressure peaks can effectively be avoided. In an embodiment, this section of the control ring can, for example, define a plunger body in the control chamber.

In an embodiment of the present invention, the pressure-relief-valve can, for example, be directly connected to the pump chamber via a pressure-relief-conduit which can be provided as a bore.

In an embodiment of the present invention, the pump outlet cavity can, for example, be fluidically directly connected to the control chamber. The direct connection between the pump outlet cavity and the control chamber can be realized by an opening which causes no relevant pressure drop even at high flow rates through the opening.

In an embodiment of the present invention, the pretensioning element can, for example, be a spring. In an embodiment, the spring can, for example, be provided as a mechanical metal spring. The spring is provided with a spring tension so that a defined pretensioning of the spring is present. The spring force determines the level of the discharge pressure of the lubricant.

A detailed description of embodiments of the present invention under reference to the drawings is set forth below.

The drawings show a lubricant vane pump 10 as a part of a pumping system for supplying an internal combustion engine with pressurized lubricant. The lubricant vane pump 10 pumps the lubricant to the combustion engine with a pump outlet pressure and is driven by the engine.

The lubricant vane pump 10 comprises a pump housing 12 with a pump inlet cavity 16 and a pump outlet cavity 14, whereby the pump housing 12 also comprises two pump chamber side walls 20 covering the pump chamber 18. The pump housing 12 also defines the pump inlet cavity 16 for sucking the lubricant from a lubricant tank and the pump outlet cavity 14 for feeding the lubricant with the pump outlet pressure to the engine. The pump chamber 18 is separated, in a circumferential direction, into a charge zone 22 which is connected to the pump inlet cavity 16, a discharge zone 24 which is connected to the pump outlet cavity 14, and an intermediate zone 26 between the charge zone 22 and the discharge zone 24.

A shiftable control ring 28 and a pump rotor 30 with seven slidable vanes 32 are arranged in the pump chamber 18. The pump rotor 30 is provided with a driven rotor hub 34 which is provided with vane slits 36, wherein the slidable vanes 32 are arranged so as to be radially shiftable. The slidable vanes 32 separate the pump chamber 18 into rotating pump compartments ($\mathbf{19}_1$-$\mathbf{19}_7$) so that the pump chamber 18 comprises seven rotating pump compartments ($\mathbf{19}_1$-$\mathbf{19}_7$). In the center of the rotor hub 34, a support ring 38 is provided which supports the radially inward ends of the slidable vanes 32. The pump rotor 30 rotates around a static rotor axis in anti-clockwise direction.

The seven rotating pump compartments ($\mathbf{19}_1$-$\mathbf{19}_7$) have a pump chamber sector angle of about 51°. Each rotating pump compartment ($\mathbf{19}_1$-$\mathbf{19}_7$) continuously rotates from the charge zone 22 via the intermediate zone 26 to the discharge zone 24 and back to the charge zone 22.

Figure 2:
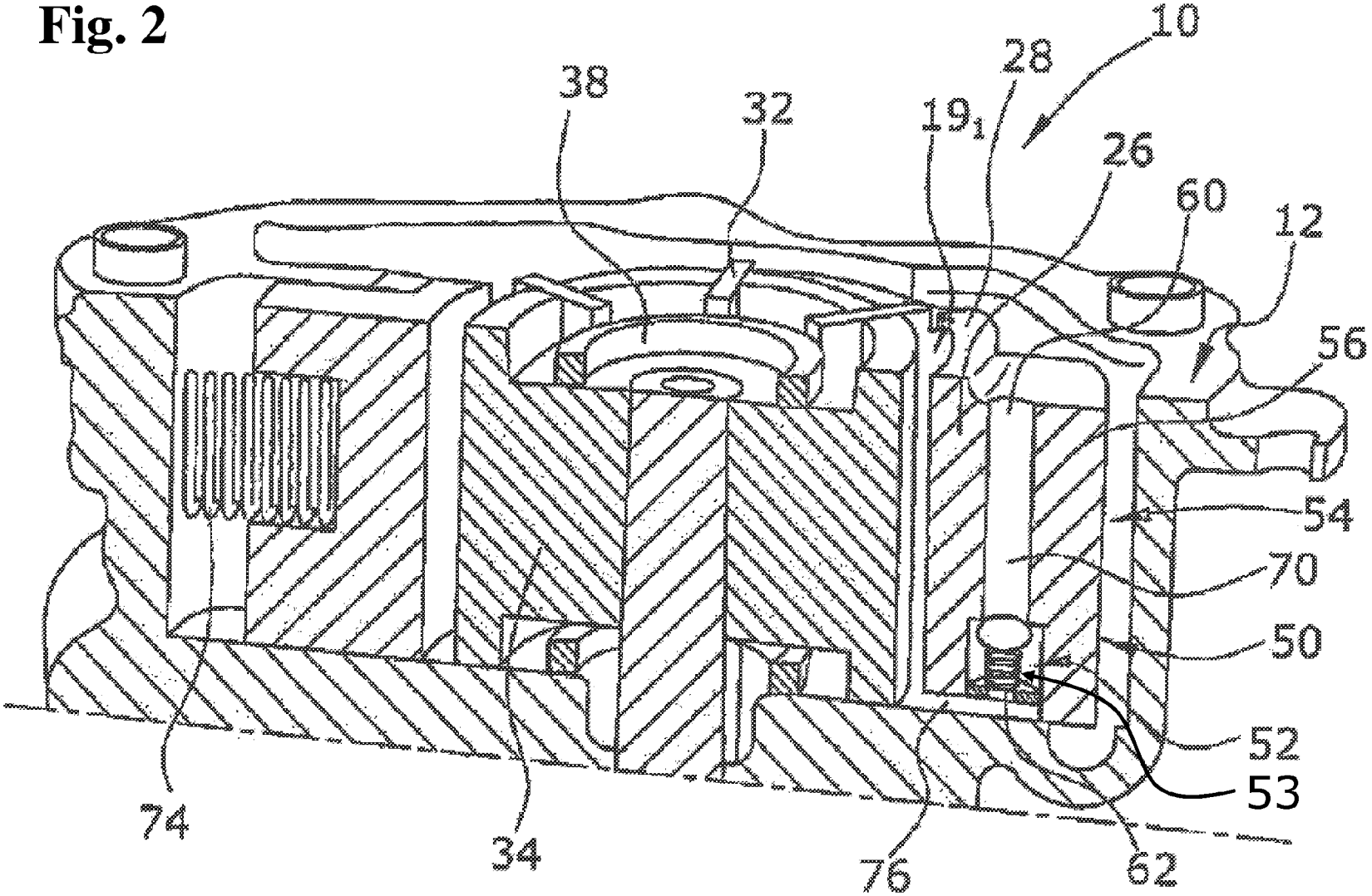
FIG. 2 shows a longitudinal cross section of the lubricant vane pump 10 of FIG. 1 in a controlled position.

FIG. 2 shows a perspective sectional view of the lubricant vane pump 10, wherein details of a valve arrangement 50 including a pressure-relief-valve 52, are shown. The lubricant, which is supplied to the engine through the pump outlet cavity 14, is also conducted via the control chamber 54 and via the pressure-relief-valve 52 to the rotating pump compartment $\mathbf{19}_1$ in the intermediate zone.

The pressure-relief-valve 52 is provided in a plunger body 56 of the control ring 28. This plunger body 56 is provided in the control chamber 54 and is pushed radially by the outlet pressure against the spring force of the counteracting pretensioning element 74. The pressure-relief-valve 52 of the shown embodiment is provided as a mechanical check-valve with a valve spring 53. The pressure-relief-valve 52 has an axial flow direction and is connected to the intermediate zone 26 via an axial inlet opening 60 and an outlet opening 62. The axial inlet opening 60 is always accessible independent of the radial position of the control ring 28.

The pressure-relief-valve 52 opens if a certain differential pressure between the pressure at the outlet opening 62 and the pressure inside the rotating pump compartment $\mathbf{19}_1$ in the intermediate zone 26 exceeds a certain constant value defined by the valve spring 62. Above the defined differential pressure, the pressure-relief-valve 52 is open, so that the differential pressure is reduced, and the liquid oscillation, the pump vibration, and the fluidic noise are reduced.

Figure 3:
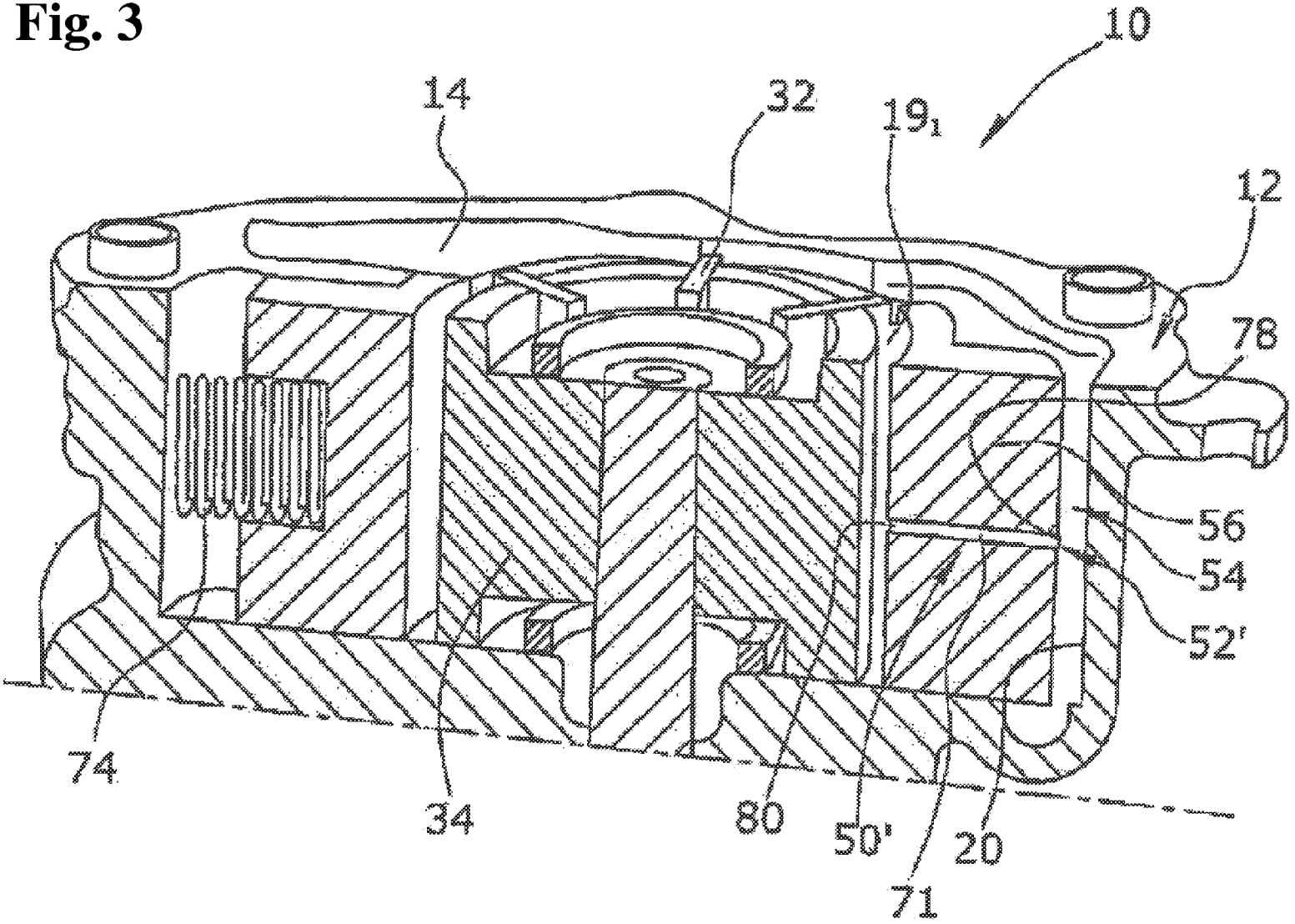
FIG. 3 shows an embodiment of a lubricant vane pump with the pressure-relief-valve in the opened position.

FIG. 3 shows a second embodiment of the valve arrangement 50'. The valve arrangement 50' is provided with a simple radial pressure relief conduit 70 comprising a distal pressure-relief-valve inlet opening 78 and a proximal outlet opening 80. The pressure relief conduit 70 is provided in the plunger body 56, whereby the radial movement of the plunger body 56 including the control ring 28 is stopped by the circumferential pump chamber wall 20 in the maximum pumping volume position. In this position, the pressure-relief-valve inlet opening 78 is covered and closed by the circumferential pump chamber wall 20 so that no pressure relief is possible in the maximum pumping volume position on the control ring 28.

As soon as the control ring 28 is not in its maximum volume pumping position, the pressure-relief-valve 52' is continuously open.

The present invention is not limited to embodiments described herein; reference should be had to the appended claims.

LIST OF REFERENCE NUMERALS

10 lubricant vane pump
12 pump housing
14 pump outlet cavity
16 pump inlet cavity
18 pump chamber
19 rotating pump compartments
20 pump chamber side wall
22 charge zone
24 discharge zone
26 intermediate zone
28 control ring
30 pump rotor
32 slidable vanes
34 rotor hub
36 vane slits
38 support ring
50, 50' valve arrangement
52, 52' pressure-relief-valve
53 valve spring
54 control chamber
56 plunger body
60 axial inlet opening
62 outlet opening
70 pressure relief conduit
71 pressure relief conduit
74 pretensioning element
76 groove
78 pressure-relief-valve inlet opening
80 proximal outlet opening

What is claimed is:

1. A lubricant vane pump for providing a pressurized lubricant for an internal combustion engine, the lubricant vane pump comprising:

a pump housing;

a pump chamber arranged in the pump housing, the pump chamber comprising a plurality of pump compartments configured to rotate from a charge zone to a discharge zone;

a shiftable control ring comprising a pressure-relief-valve arranged in the pump housing, the shiftable control ring being configured to envelop the pump chamber;

a pump rotor arranged in the pump housing, the pump rotor comprising radially slidable vanes which are configured to rotate in the shiftable control ring so as to provide the pump chamber with the plurality of rotating pump compartments;

a pretensioning element configured to push the shiftable control ring into a high pumping volume position;

a control chamber, wherein a high lubricant pressure in the control chamber moves the shiftable control ring into a low pumping volume direction against the pretensioning element; and a pump outlet cavity which is fluidically connected to the control chamber, wherein, the pressure-relief-valve of the shiftable control ring is configured to connect or disconnect the control chamber with one of the plurality of pump compartments between the charge zone and the discharge zone under a defined connection condition.

2. The lubricant vane pump as recited in claim 1, wherein the pressure-relief-valve is further configured to open when an over-pressure in the control chamber with respect to the pump compartment is exceeded.

3. The lubricant vane pump as recited in claim 1, wherein, the pressure-relief-valve comprises a valve inlet opening, and the control chamber comprises a control chamber wall portion, wherein, the valve inlet opening is covered by the control chamber wall portion when the shiftable control ring is in the high pumping volume position.

4. The lubricant vane pump as recited in claim 1, wherein the pressure-relief-valve is provided as a mechanical check-valve.

5. The lubricant vane pump as recited in claim 1, wherein, the shiftable control ring comprises a section in an intermediate zone arranged between the charge zone and the discharge zone, and the pressure-relief-valve is arranged in the section.

6. The lubricant vane pump as recited in claim 5, wherein the section of the shiftable control ring defines a plunger body in the control chamber.

7. The lubricant vane pump as recited in claim 1, further comprising:

a pressure-relief-conduit, wherein, the pressure-relief-valve is directly connected to the pump chamber via the pressure-relief-conduit.

8. The lubricant vane pump as recited in claim 1, wherein the pump outlet cavity is directly fluidically connected to the control chamber.

9. The lubricant vane pump recited in claim 1, wherein the pretensioning element is a spring.

* * * * *